US006116332A

United States Patent [19]

Vännman et al.

[11] Patent Number: 6,116,332

[45] Date of Patent: Sep. 12, 2000

[54] PLATE HEAT EXCHANGER AND A SUPPORT ARRANGEMENT FOR A PLATE HEAT EXCHANGER

[75] Inventors: Erik Vännman, Helsingborg; Richard Jönsson, Stehag; Bo Nilsson, Kävlinge; Göran Andersson, Lund, all of Sweden

[73] Assignee: Alfa Laval AB, Tumba, Sweden

[21] Appl. No.: 09/308,119

[22] PCT Filed: Nov. 12, 1997

[86] PCT No.: PCT/SE97/01899

§ 371 Date: Jun. 22, 1999

§ 102(e) Date: Jun. 22, 1999

[87] PCT Pub. No.: WO98/21539

PCT Pub. Date: May 22, 1998

[30] Foreign Application Priority Data

Nov. 14, 1996 [SE] Sweden ..... 9604153

[51] Int. Cl.[7] ..... F28D 9/00

[52] U.S. Cl. ..... 165/81; 165/167; 165/DIG. 364

[58] Field of Search ..... 165/81, 167, DIG. 359, 165/DIG. 364

[56] References Cited

U.S. PATENT DOCUMENTS 5,722,486 3/1998 Blomgren et al. ..... 165/167
5,797,446 8/1998 Blomgren ..... 165/81
5,964,280 10/1999 Wehrmann et al. ..... 165/140

FOREIGN PATENT DOCUMENTS

WO 84/03555 9/1984 WIPO .
WO 86/04134 7/1986 WIPO .
WO 88/00682 1/1988 WIPO .
WO 95/31687 11/1995 WIPO .

*Primary Examiner*—Allen Flanigan
*Attorney, Agent, or Firm*—Fish & Richardson P.C.

[57] ABSTRACT

A plate heat exchanger comprises a plate package (2) of heat transfer plates (3) provided with ports (12), which is arranged between two frame plates (4, 5), at least one (4) of the frame plates being provided with connection pipes (7). The invention concerns a support arrangement to avoid bending of a portion that surrounds each of the ports (12) of an outer heat transfer plate (10) in the plate package (2). Each connection pipe (7) on its inside is provided with a lining (9), which is radially movable in the connection pipe (7) and permanently connected with the outer heat transfer plate (10) around its relevant port (12). The support arrangement is constituted by a ring (14) arranged around the lining (9). The ring (14) supports the outer heat transfer plate (10) and abuts against a support surface, which is fixed in relation to the frame plate (4).

8 Claims, 3 Drawing Sheets

PLATE HEAT EXCHANGER AND A SUPPORT ARRANGEMENT FOR A PLATE HEAT EXCHANGER

FIELD OF THE INVENTION

A plate heat exchanger and a support arrangement for a plate heat exchanger The present invention concerns a plate heat exchanger which comprises a plate package of heat transfer plates, between which passages for two heat exchange fluids are formed. The heat transfer plates are provided with ports forming channels through the plate package for at least one of the heat exchange fluids. Said plate package is arranged between two frame plates, at least one of which is provided with a through hole communicating with one of said channels. At least one connection pipe is firmly connected with said one frame plate around its through hole and at least one tubular lining is arranged inside said connection pipe and within the through hole of said one frame plate in such a way that it is radially movable relative to the frame plate. The lining is permanently connected with an outer heat transfer plate of said plate package, situated closest to the frame plate, around one of the ports of the outer heat transfer plate. The invention also concerns a support arrangement for a plate heat exchanger of the kind mentioned above.

BACKGROUND OF THE INVENTION

In plate heat exchangers of the kind described above the heat transfer plates and the linings are thin and get into direct contact with the heat exchange fluids, the result of which is that these parts of the plate heat exchanger will rapidly adopt the temperature of the heat exchange fluids and, thereby, will undergo quick changes in length. The frame plates, on the other hand, are considerably thicker than the heat transfer plates and the linings, and the frame plates do not get into direct contact with the heat exchange fluids. Thus, the frame plates with their one, inner sides are in contact with respective outer heat transfer plates of said plate package and with their other, outer sides are in contact with ambient air. Thereby, the frame plates undergo a smaller and, above all, slower change in length than the heat transfer plates.

The different changes in length of the heat transfer plates and the frame plates can lead to strength problems in the lining, in the connection between the lining and the outer heat transfer plate and in the portions around the ports of the outer heat transfer plate. In order to reduce these strength problems the lining, as initially mentioned, is arranged radially movable relative to the frame plate. An arrangement of this kind is described in WO 95/31687 A.

The radial movability of the lining relative to the frame plate necessitates a gap between the lining and the frame plate. The result of this gap is that the outer heat transfer plate, in an area around its port, has no support surface to abut against. As the fluid pressure in the plate package is high the outer heat transfer plate is subjected to bending in said area, the risk of material failure, primarily due to fatigue, being great. When the lining is displaced from a centered position in the through hole of the frame plate, as a result of the different changes in length of the frame plate and the plate package, the portion of the outer heat transfer plate, that is subjected to bending, becomes particularly large. For example, if the width of the gap is doubled the bending is almost quadrupled.

SUMMARY OF THE INVENTION

The object of the present invention is to eliminate the above said risk of material failure in the outer heat transfer plate of a plate heat exchanger of the initially described kind while maintaining the radial movability of the lining relative to the frame plate. According to the invention this object can be achieved by means of a support arrangement, which is adapted to counteract bending of said outer heat transfer plate in a portion thereof around its said port and which comprises a ring extending around the lining. The ring shall be arranged to abut by its one side axially against said portion of the outer heat transfer plate and by its other side against a support surface provided therefor, which is fixed in relation to the frame plate.

By the invention the portion around the port of the outer heat transfer plate, which was earlier subjected to bending, will be supported. For maintenance of the radial movability of the lining relative to the frame plate there is a small gap between the lining and the ring and/or a small gap between the ring and the frame plate. By giving the ring suitable inner and outer diameters the gap, alternatively the gaps, can be made exactly as wide as necessary for maintenance of the desired radial movability of the lining relative to the frame plate. The gap, alternatively one of the gaps, can be located at a portion of the outer heat transfer plate which is less sensitive to bending than is the portion closest to the port.

According to the invention said connection pipe may be connected with the frame plate in two different ways, either on the outside of the frame plate or within its through hole. In both cases the frame plate, on its side abutting against the plate package, may be provided around its said through hole with a recess for said ring. In case the connection pipe is connected with the frame plate within its through hole the end surface of the connection pipe may form said support surface in the through hole. Such an arrangement can of course be supplemented by a recess in the frame plate, so that the support surface for the ring is formed by both the end surface of the pipe and the frame plate. According to a particular embodiment of the invention the ring is radially movable relative to the frame plate but not relative to the lining. The ring in this way can move radially together with the lining and, thereby, always support the outer heat transfer plate in the portion thereof closest to its port. The gap which in this case is present between the ring and the frame plate is situated at a portion of the outer heat transfer plate that is relatively insensitive to bending at some distance from the connection between the plate and the lining. Furthermore, the outer heat transfer plate is supported on both sides of the gap.

According to a preferred embodiment the ring is also radially movable relative to the lining. In this embodiment two gaps are formed, one between the lining and the ring and one between the ring and the frame plate. The gap between the lining and the ring can, for example, be one third of the width of the gap between the ring and the frame plate. Each of the bendings of the outer heat transfer plate in this embodiment becomes considerably smaller than the respective bendings of the embodiments having only one gap. One important advantage of the preferred embodiment just described, compared to the other embodiments, is that a required or desired support for the outer heat transfer plate can be obtained by means of a smallest possible recess in the frame plate.

One general advantage of the invention is that plate heat exchangers can be produced to suit customers' desires and fields of application in a simple and inexpensive manner. The frame plates for plate heat exchangers of a certain size are all produced with recesses of the same size. Thereafter, depending on the field of application for a specific plate heat exchanger, rings having a size suitable for the intended field of application are placed around the linings in the recesses. For example, if a lining need not have a maximum radial movability relative to the frame plate, i.e. the plate heat exchanger will not be flowed through by heat exchange fluid of maximum allowed temperature, a higher fluid pressure can be allowed in the plate heat exchanger.

BRIEF DESCRIPTION OF THE DRAWINGS

The present invention will be explained in greater detail with reference to the accompanying drawings in which.

DETAILED DESCRIPTION

Figure 1:
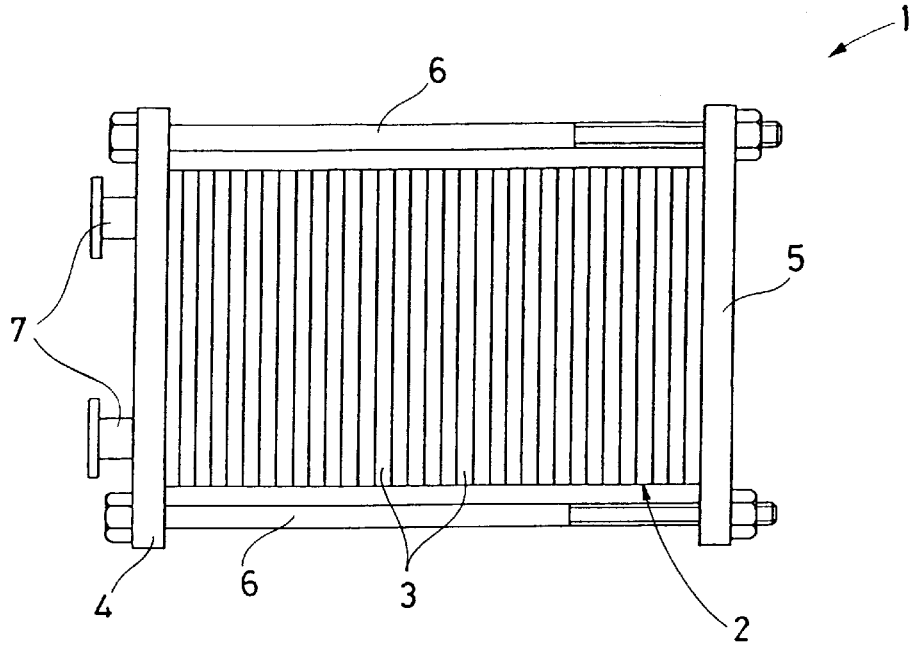
FIG. 1 shows a plate heat exchanger seen from above and FIG. 2 shows a section through an inlet or an outlet of a plate heat exchanger according to a preferred embodiment of the invention.

FIG. 1 shows a plate heat exchanger 1 having permanently, to a plate package 2, joined heat transfer plates 3 for heat exchange between two heat exchange fluids. Each heat transfer plate 3 is provided with four ports, which form two inlet and two outlet channels through the plate package 2. The plate package 2 is arranged between two frame plates 4, 5, which are held together by bars 6. One 4 of the frame plates is provided with four connection pipes 7, the interior of which communicates with the respective inlet and outlet channels in the plate package 2. (Only two connection pipes 7 are shown.)

Each of the two heat exchange fluids flows into the plate heat exchanger 1 through a connection pipe 7 communicating with an inlet channel, further through plate interspaces between the heat transfer plates 3 to an outlet channel and from there through a connection pipe 7 out of the plate heat exchanger. Adjacent plate interspaces are flowed through by different heat exchange fluids.

Figure 2:
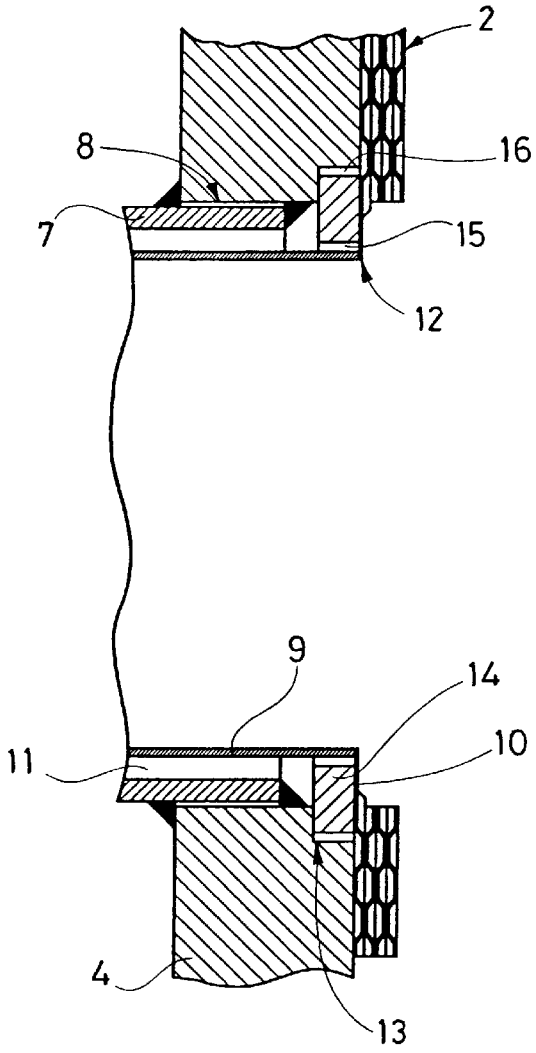

FIG. 2 shows a section through, for example, one of the inlets of a plate heat exchanger designed according to a preferred embodiment of the invention. All the inlets and outlets of the plate heat exchanger can be formed in the same way. The frame plate 4 is provided with a through hole 8 within which one of the connection pipes 7 is firmly connected to the frame plate 4. To protect the frame plate 4 and the connection pipe 7 from contact with heat exchange fluid the connection pipe 7 on its inside is provided with a likewise tubular lining 9. This lining 9 is permanently connected with an outer heat transfer plate 10 of the plate package 2. Since the plate package 2 is flowed through by heat exchange fluid having a temperature different than that of the surroundings the plate package 2 is subjected to changes in length relative to the frame plate 4 in parallel therewith. When the plate package 2 changes in length the lining 9 is displaced radially relative to the frame plate 4 and the connection pipe 7. For this to be possible there is a gap 11 between the connection pipe 7 and the lining 9.

During operation of the plate heat exchanger the outer heat transfer plate 10 in the portion around its port 12 is exposed to pressure as a consequence of the fluid pressure in the plate heat exchanger. To avoid bending of this portion of the heat transfer plate 10 the frame plate 4 on its inside is provided with a recess 13 around the through hole 8, and in the recess 13 there is a ring 14 extending around the lining 9. The ring 14 prevents bending of the outer heat transfer plate 10 by abutting by its one side axially against the outer heat transfer plate 10 and by its other side axially against the frame plate 4 in the recess 13. To make possible the radial movability of the lining 9 there is also an annular gap 15 between the lining 9 and the ring 14 and an annular gap 16 between the ring 14 and the frame plate 4.

Figure 3A:
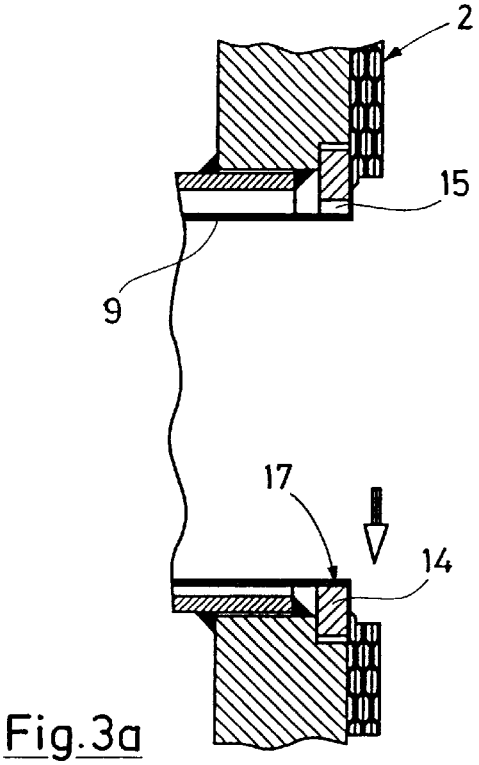
FIGS. 3*a* and 3*b* show in detail the function of the embodiment of the invention according to FIG. 2.
Figure 3B:
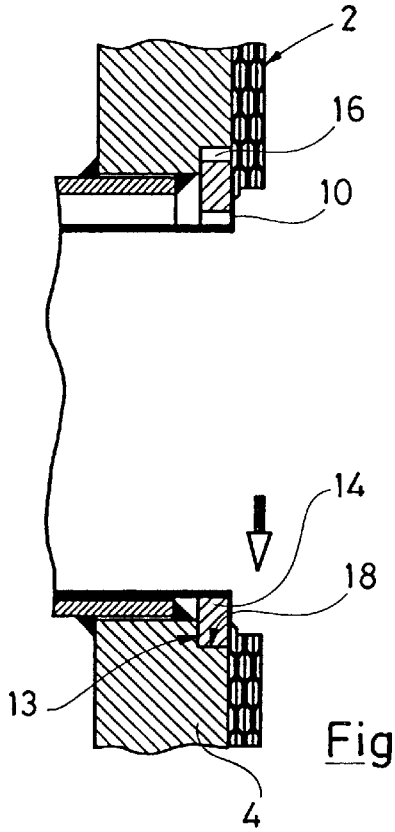

In FIG. 2 the lining 9 is shown centered in the connection pipe 7. In FIG. 3*a* the plate package 2 has been subjected to a certain change in length relative to the frame plate 4 in a direction indicated by an arrow, the lining 9 having been displaced radially so that it has got into contact with the ring 14 at 17. The gap 15 thereby has adopted the shape of a sickle, whereas the gap 16 is still annular. FIG. 3*b* shows the plate package 2 after further change in length in the direction of the arrow, the lining 9 having been displaced to such an extent that the ring 14 has got into contact with the radially boundering surface of the recess 13 at 18. Now, also the gap 16 has the shape of a sickle. In this embodiment the ring 14 gives support to the outer heat transfer plate 10 while maintaining, upon radial displacement of the lining 9, axial support against the frame plate over a relatively large contact surface.

Figure 4A:
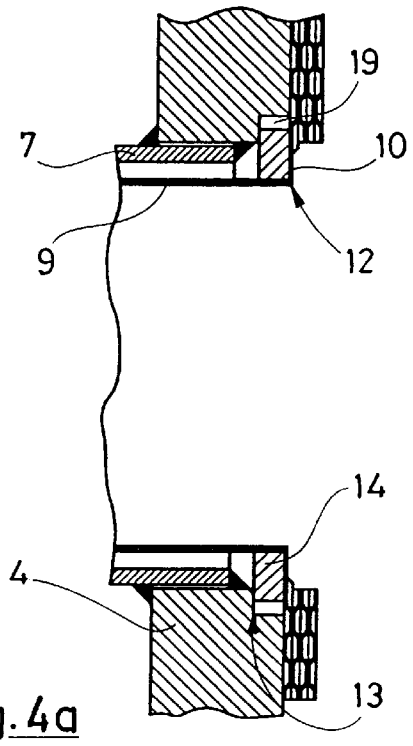
FIGS. 4*a*, 4*b* and 5*a*, 5*b* show two other embodiments of the invention.
Figure 4B:
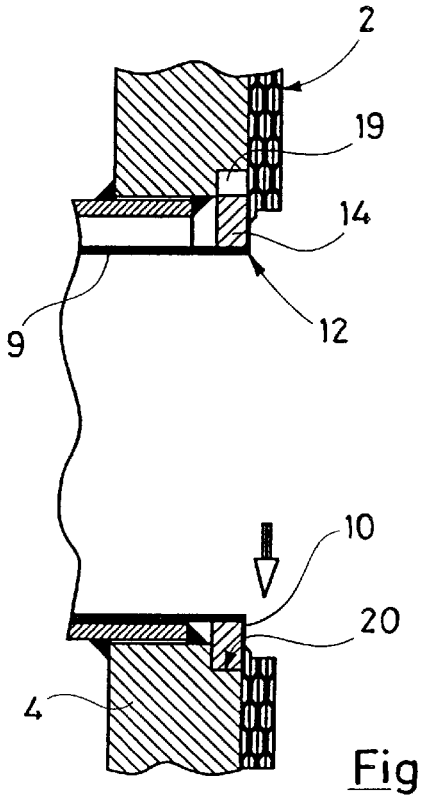

Another embodiment of the invention is shown in FIGS. 4*a* and 4*b*. In this embodiment the ring 14 has a shape such that only one gap 19 is formed, which is situated between the ring 14 and the frame plate 4. This gap 19 is placed opposite to a portion of the outer heat transfer plate 10, which is relatively insensitive to bending. The outer heat transfer plate is, namely, often corrugated in the area of this gap 19, which stiffens the heat transfer plate 10. Furthermore, the outer heat transfer plate 10 is supported on both sides of the gap 19 by the ring 14 and the frame plate 4, respectively. In FIG. 4*a* the lining 9 is shown centered in the connection pipe 7, and in FIG. 4*b* the plate package 2 has been subjected to change in length in the direction shown by the arrow, the lining 9 and the ring 14 having been displaced radially so that the ring 14 has got into contact with the frame plate 4 at 20. The gap 19 has then adopted the shape of a sickle. In the embodiment of the invention shown in FIGS. 4*a* and 4*b* there is provided better support for the portion around the port 12 of the outer heat transfer plate 10 than in the embodiment according to FIGS. 2, 3*a* and 3*b*. however, at the radial displacement of the lining 9 and the ring 14 as shown, the axial support surface for the ring 14 in the recess 13 is smaller than the corresponding support surface in the embodiment according to FIGS. 2, 3*a* and 3*b*.

Figure 5A:
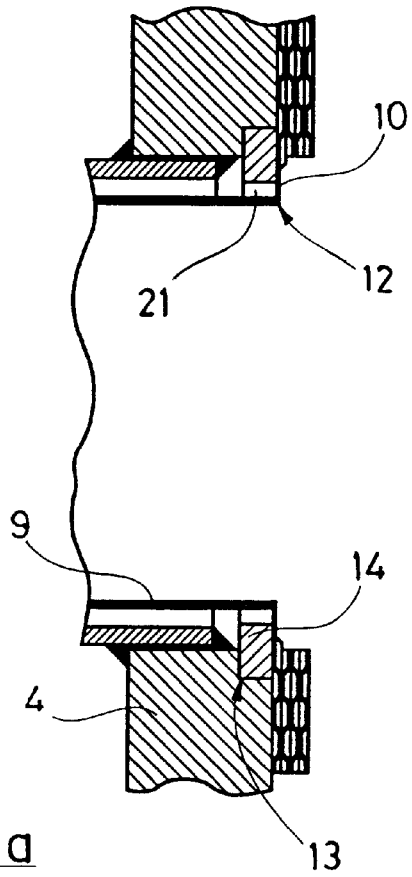
Figure 5B:
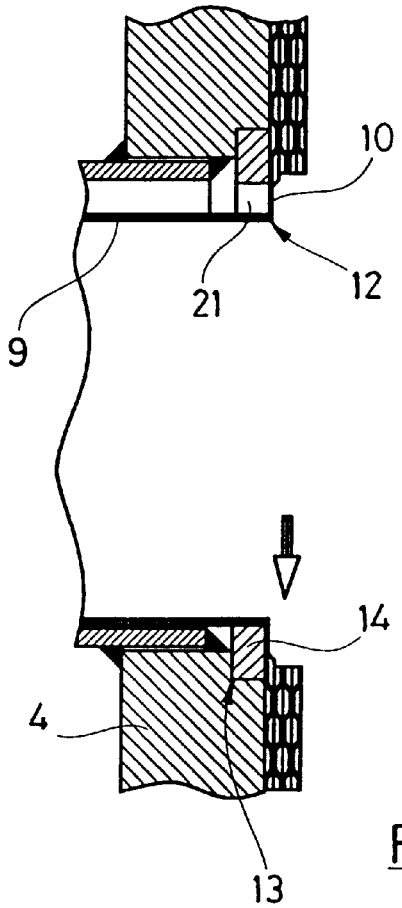

FIGS. 5*a* and 5*b* show a further embodiment of the invention, in which a gap 21 is formed between the lining 9 and the ring 14. In this case there is no gap between the ring 14 and the frame plate 4 and, therefore, the ring 14 can not move relative to the frame plate. The gap 21 allows radial displacement of the lining 9 relative to the frame plate 4, and in FIGS. 5*a* and 5*b* the lining 9 is shown before respectively and after such a displacement. The ring 14, at the outer heat transfer plate 10, fills out the space formed in the through hole 8 of the frame plate 4 between the axial end surface of the connection pipe 7 and the outer heat transfer plate 10.

It should be pointed out, as shown in the FIGS. 2, 3*a*, 3*b*, 4*a*, 4*b* and 5*a*, 5*b*, that the outer heat transfer plate 10 has ports (12) with a diameter smaller than that of the the ports in the remaining heat transfer plates of the plate package 2. The outer heat transfer plate 10, thus, has portions around its ports 12, having no counterparts in the remaining plates of the plate package 2. Falling within the scope of the invention are both the possibility that these portions have originally been formed in one piece with the outer heat transfer plate 10, and the possibility that they have later been firmly connected therewith. For example, they may have constituted parts of the respective linings 9 and been connected with the outer heat transfer plate 10 only when the linings 9 were connected therewith, e. g. by welding.

What is claimed is:

1. A plate heat exchanger comprising a plate package (2) of heat transfer plates (3), between which passages are formed for two heat exchange fluids, the heat transfer plates (3) being provided with ports forming channels through the plate package (2) for at least one of the heat exchange fluids, two frame plates (4, 5) between which said plate package (2) is arranged, at least one (4) of the frame plates being provided with at least one through hole (8) communicating with one of said channels, at least one connection pipe (7) firmly connected with said one frame plate (4) around its through hole (8), at least one tubular lining (9), which is arranged inside said connection pipe (7) and within the through hole (8) of said one frame plate (4) in such a way that it has a radial movability relative to the frame plate (4), the lining (9) further being permanently connected with an outer heat transfer plate (10) of said plate package (2), situated closest to the frame plate (4), around one of the ports (12) of the outer heat transfer plate (10), and a support arrangement for counteracting bending of said outer heat transfer plate (10) in a portion thereof around its said port (12) and permitting said movability of the lining (9), said arrangement comprising a ring (14) which extends around the lining (9) and is arranged to abut by its one side axially against said portion of the outer heat transfer plate (10) and by its other side against a support surface provided therefor, which is fixed in relation to the frame plate (4).

2. A plate heat exchanger according to claim 1, wherein the frame plate (4) has a recess (13) for said ring (14), the ring being arranged to abut against the frame plate (4) by its said other side.

3. A plate heat exchanger according to claim 2, wherein said connection pipe (7) abuts against the outer side of the frame plate (4).

4. A plate heat exchanger according to claim 1, wherein said connection pipe (7) extends a bit into the through hole (8) of the frame plate (4).

5. A plate heat exchanger according to, claim 1, wherein the ring (14) is arranged by its said other side to abut against the connection pipe (7), which forms at least a part of said support surface.

6. A plate heat exchanger according to claim 1, wherein, characterized in that the ring (14) is radially movable relative to the frame plate (4).

7. A plate heat exchanger according to claim 6, wherein the ring (14) is radially movable relative to the lining (9).

8. A support arrangement for a plate heat exchanger for counteracting bending of an outer heat transfer plate (10) with ports, in a plate package (2) of heat transfer plates (3), in a plate portion around one of the ports (12) of the outer heat transfer plate (10), said plate heat exchanger comprising said plate package (2) of heat transfer plates (3), between which passages for two heat exchange fluids are formed, the heat transfer plates (3) being provided with ports forming channels through the plate package (2) for at least one of the heat exchange fluids, two frame plates (4, 5) between which said plate package (2) is arranged, at least one (4) of the frame plates being provided with at least one through hole (8) which communicates with one of said channels, at least one connection pipe (7) firmly connected with said one frame plate (4) around its through hole (8), at least one tubular lining (9), which is arranged inside said connection pipe (7) and within the through hole (8) of said one frame plate (4) in such a way that it has a radial movability relative to the frame plate (4), the lining (9) further being permanently connected to said outer heat transfer plate (10) of the plate package (2), situated closest to the frame plate (4), around its said port (12), characterized in that the arrangement comprises a ring (14), which is dimensioned to extend around the lining (9) and which is formed to abut by its one side axially against said portion of the outer heat transfer plate (10) and by its other side against a support surface provided therefor, which is fixed in relation to the frame plate (4), the arrangement being adapted to allow said movability of the lining (9).

* * * * *

UNITED STATES PATENT AND TRADEMARK OFFICE

CERTIFICATE OF CORRECTION

PATENT NO. : 6,116,332
DATED : September 12, 2000
INVENTOR(S) : Vannman et al.

It is certified that error appears in the above-identified patent and that said Letters Patent is hereby corrected as shown below:

Column 1,
Lines 1-2, delete "A plate heat exchanger and a support arrangement for a plate heat exchanger."

Column 4,
Line 42, change "however" to -- However -- .

Column 5,
Line 44, delete "a bit".

Column 6,
Line 6, delete "characterized in that".
Line 36, change "characterized in that" to -- and wherein -- .

Signed and Sealed this

Eleventh Day of September, 2001

*Attest:*

Nicholas P. Godici

*Attesting Officer*

NICHOLAS P. GODICI
*Acting Director of the United States Patent and Trademark Office*